US011643821B2

(12) United States Patent
Vernon

(10) Patent No.: US 11,643,821 B2
(45) Date of Patent: May 9, 2023

(54) MOUNTING SYSTEM FOR ARCHITECTURAL PANELS

(71) Applicant: EVERGROW INTERNATIONAL TRADING (SHANGHAI) CO., LTD., Shanghai (CN)

(72) Inventor: Philip Andrew Vernon, Colorado Springs, CO (US)

(73) Assignee: DIGITAL ENVIRONMENT CONSTRUCTION, LLC, Colorado Springs, CO (US)

( * ) Notice: Subject to any disclaimer, the term of this patent is extended or adjusted under 35 U.S.C. 154(b) by 10 days.

(21) Appl. No.: 17/210,355

(22) Filed: Mar. 23, 2021

(65) Prior Publication Data

US 2021/0293031 A1 Sep. 23, 2021

Related U.S. Application Data

(60) Provisional application No. 62/993,107, filed on Mar. 23, 2020.

(51) Int. Cl.
*E04F 13/08* (2006.01)
*E04F 13/14* (2006.01)

(52) U.S. Cl.
CPC ..... *E04F 13/0855* (2013.01); *E04F 13/145* (2013.01)

(58) Field of Classification Search
CPC .. E04F 13/0853; E04F 13/0855; E04F 13/145
USPC ..... 52/506.05, 506.06
See application file for complete search history.

(56) References Cited

U.S. PATENT DOCUMENTS 4,689,928 A * 9/1987 Dutton ..... E04F 13/081 52/235
5,265,396 A * 11/1993 Amimoto ..... E04F 13/0855 52/235
5,921,698 A * 7/1999 Hegen ..... F16C 11/0685 403/260
6,098,364 A * 8/2000 Liu ..... E04F 13/0855 52/235
6,418,010 B1 * 7/2002 Sawyer ..... F16M 11/14 361/801
6,430,894 B1 * 8/2002 Chae ..... E04B 2/885 52/204.593
7,603,820 B1 * 10/2009 Lai ..... E06B 3/5445 403/56
8,468,765 B1 * 6/2013 Kim ..... E04F 13/14 52/510
2008/0163579 A1 * 7/2008 Kreyenborg ..... E06B 3/5436 52/474

* cited by examiner

*Primary Examiner* — William V Gilbert
(74) *Attorney, Agent, or Firm* — Hovey Williams LLP

(57) ABSTRACT

The invention concerns a mounting system to support free-form architectural panels, in particular molded panels made from fiber composite materials such as concrete, resin, and gypsum. The mounting system comprises a socket which can be securely embedded in the panel during casting. The mounting system further comprises a ball joint which is clamped into the socket and allows for attachment of the panel to support structure.

14 Claims, 2 Drawing Sheets

M
1
2
3
4
5
6
7
8
9
10
11
12
13
14
15
16
17
18
19
20
21
22
23
24
25
26
27
28
s

MOUNTING SYSTEM FOR ARCHITECTURAL PANELS

RELATED APPLICATION

This present application is a non-provisional patent application and claims priority benefit, with regard to all common subject matter, of earlier-filed U.S. provisional patent application titled "MOUNTING SYSTEM FOR ARCHITECTURAL PANELS", Ser. No. 62/993,107, filed on Mar. 23, 2020, and is hereby incorporated by reference in its entirety into the present application.

BACKGROUND

The following detailed description of embodiments of the invention is intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the present invention is defined only by claims presented in subsequent regular utility applications, along with the full scope of equivalents to which such claims are entitled.

In this description, references to "one embodiment," "an embodiment," or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, step, etc. described in one embodiment may also be included in other embodiments, but is not necessarily included. Thus, the present technology can include a variety of combinations and/or integrations of the embodiments described herein.

BACKGROUND OF THE INVENTION

The present invention relates to mounting systems for architectural panels. More particularly, the invention relates to a mounting system configured for mounting free-form composite panels and other non-planar panels to buildings and other structures.

Glass panels are often mounted to buildings and other structures as cladding. Ball-joint type connectors are often used to mount the panels because they fix the panels in translation and thus prevent any local bending of the panels at the connection points. This allows for higher loading of the glass panels. However, due to their design, current ball-joint connectors only work well with glass panels and other planar panels that do not require much rotation at their mounting joints and are ineffective for use with panels that require significant rotation to accommodate variations in the shape or form of the panels. Additionally, current ball-joint type connectors require drilling or cutting of the panels after the panels are formed to open holes through which they are fixed.

Thus, a need exists for a panel mounting system that can accommodate a wider range of panel geometries and that requires no drilling or cutting of the panels after they are formed.

Non-planar panels are often mounted to buildings, art works, and other structures for decorative purposes. Such panels are often referred to as "free-form panels" and may be formed of fiber-composites which are either hand-laid or sprayed-up and/or other cast or settable materials such as concrete or gypsum. As mentioned above, such non-planar panels can be more difficult to mount than planar glass panels.

Cast-in-place connectors (often referred to as "embeds") exist for attaching such non-planar panels to buildings or other structures. Embeds are typically placed in these panels during the casting process with extra material applied around the embed for reinforcement. This is known in the industry as a bonding-pad or as encapsulation. Most of these connectors are embedded sockets or channels and are intended and designed for fixation only, forces from expansion contraction not being considered.

More particularly, most embeds have planar connection surfaces, and although they may be used in non-planar free-form panels, their shape and configuration render their attachment difficult and complex. Other hardware must be used to resolve any differences in geometry between the panels and the supporting structures as well as to resolve differences in movement between the panels and the structures due to differences in thermal expansion or endogenous shrinkage of the composite material in the panels.

One type of embed incorporates an L-shaped bracket. Such embeds must be attached perpendicularly from the surface of a panel. In the case of free-form panels, this necessitates a complex back-frame which follows the curves of the panels. Such back-frames are expensive to produce and difficult to install.

Additionally, it is impossible to embed all such brackets with precisely the same axis of orientation, particularly in panels with free-form geometries. While uniformly aligned embed placement is possible, in practice it's nearly impossible, resulting in some misaligned panels and stresses occurring in the bonding-pads where freedom of movement is restricted. These unforeseen stresses ultimately result in cracking at the bonding pads which can lead to critical panel and/or mounting system failure. In small panels or panels with planar geometries, such misalignments are either negligible or not problematic. However, in larger panels or in panels with complex geometries, both the possibility and consequence of misalignment are higher. In panel systems where multiple panels are joined together to form a single surface, the stresses to the bonding pads due to misalignment increase proportionally to size of the joined surfaces. Additionally, it is difficult to predict, model, or calculate the stresses which are caused by such misalignments because the misalignments are the result of hand labor during assembly.

Thus, a need also exists for a panel mounting system that is able to accommodate free-form panel geometries and to transfer stresses from thermal expansion, endogenous shrinkage or other loads in a predictable, calculable manner to bonding pads or other mounting points. In addition, such a mounting system must perform the above despite unknown misalignments and fabrication tolerances that occur during the placement process.

SUMMARY OF THE INVENTION

Embodiments of the present invention solve the above-described problems and related problems by providing an improved mounting system for non-planer panels such as panels formed of cast materials. Embodiments of the invention accommodate the mounting of free-form panel geometries to rectilinear structures and allow full rotational freedom so that no bending stresses are incurred in the panels from differential thermal expansion or endogenous shrinkage of the material in the panels.

DETAILED DESCRIPTION OF THE PREFERRED EMBODIMENTS

Figure 1:
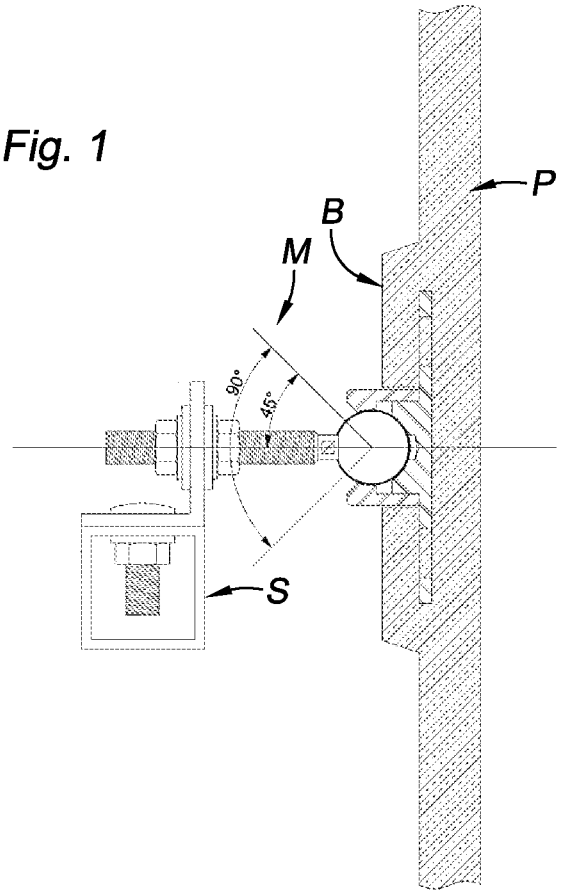
FIG. 1 shows a mounting system constructed in accordance with an embodiment of the invention schematically in longitudinal section.
Figure 2:
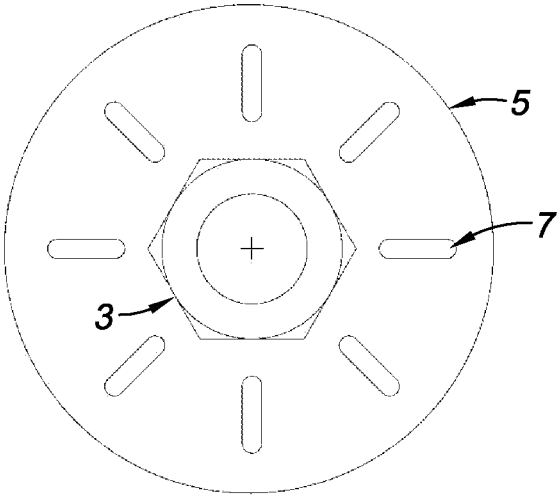
FIG. 2 is an end view of the mounting system.

FIG. 1 shows a composite panel P attached to a support structure S by a mounting system M constructed in accordance with an embodiment of the invention. A portion of the mounting system M is embedded within the panel and encapsulated by a bonding pad B of the same material as panel P. The mounting system may be used with any panel and any support structure.

Figure 3:
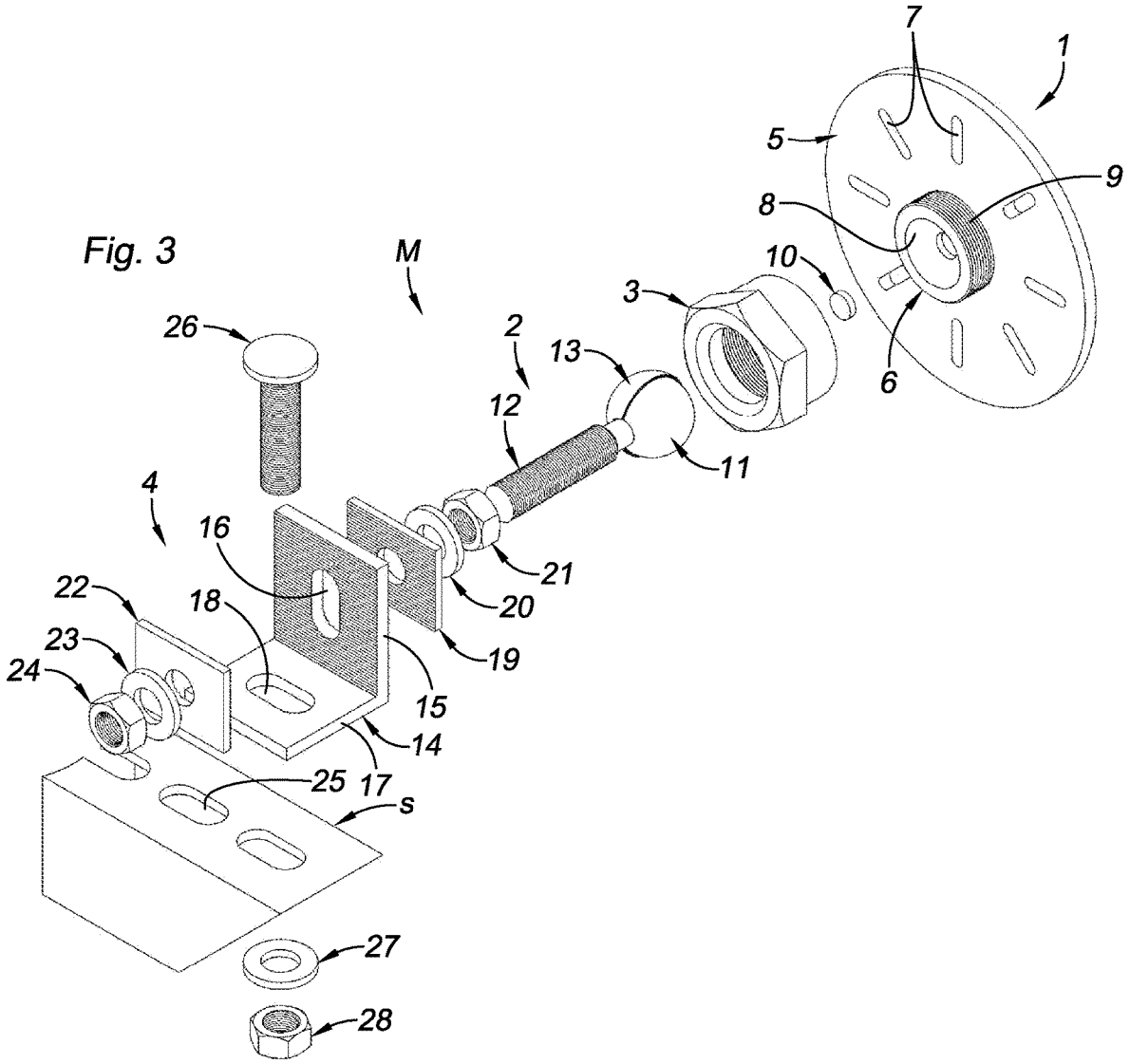
FIG. 3 is an exploded view of the mounting system.

As best depicted in FIG. 3, an embodiment of the mounting system M broadly comprises a plate assembly 1; a ball assembly 2, a locking collar 3, and attachment structure 4.

The plate assembly 1 attaches to the panel P and includes a plate 5 configured to be embedded within the panel and a socket 6 extending orthogonally from the plate and configured to extend out from one side of the panel.

An embodiment of the plate 5 is formed of stainless steel or other metals or composites and is flat and circular. In one embodiment, the plate is approximately ⅛-½" thick and 3-8" in diameter. Slots or holes 7 may be formed in the plate to allow for the flow of materials used to form the panel to better distribute forces through the panel and its bonding pad.

The socket 6 extends from one face of the plate 5 and has a semi-spherical interior surface 8 and a cylindrical, externally threaded outer surface 9. A rubber component 10 may be placed in the socket to provide shock absorption in case of dynamic loads and extra friction against panel rotation during panel installation.

The ball assembly 2 includes a spherical ball 11 configured to nest in the socket 6 of the plate assembly and a threaded bolt 12 extending from the spherical ball. In one embodiment, the spherical ball is between 1-4" in diameter. The spherical ball 11 may be encapsulated with a resilient plastic sleeve 13 or coating such that the joint between the ball and the socket is self-lubricated. The plastic sleeve 13 or coating also prevents bi-metallic reactions by isolating the components for embodiments where some of the components are made from stainless steel and other components made from other materials. For example, in some embodiments, the plate assembly 1 is made from stainless steel while the ball assembly 2 is made of less expensive grades of metal. Additionally, the resilient plastic sleeve can absorb some shock from dynamic loads.

The locking collar 3 is internally threaded and configured to be threaded over the socket 6 to trap the spherical ball 11 in the socket 6. The locking collar 3 allows the ball to resist and transfer translational forces while still allowing it to rotate freely relative to the plate assembly. In preferred embodiments, the spherical ball 11 may rotate 90° in any direction relative to the socket 6 such that the panel P may be mounted to a rectilinear structure S regardless of the desired angle between the panel and the support structure. However, the mounting system and other embodiments thereof may have other degrees of rotation without departing from the scope of the invention.

The attachment structure 4 attaches the ball assembly 2 to the support structure 5 such that the panel P may rotate relative to the support structure 5 in any direction but cannot translate relative to the support structure.

An embodiment of the attachment structure 4 includes an L-shaped bracket 14 having a first serrated leg 15 with a first slot 16 and a second leg 17 with a second slot 18. The first and second legs extend orthogonally relative to one another. The attachment structure also includes fasteners (embodiments described below) for fixing the threaded bolt 12 of the ball assembly in the first slot of the first leg of the bracket and fasteners for attaching the second leg of the bracket to the support structure.

In one embodiment, the threaded bolt 12 is inserted through the slot 16 in the first serrated leg 15 of the bracket 14 and is locked into vertical position via a serrated washer 19, isolation washer 20, and nut 21 on one side of the leg and a serrated washer 22, an isolation washer 23, and nut 24 on the opposite side of the leg. This permits vertical adjustment of the panel P relative to the support structure during installation. When the nuts 21, 24 are tightened, the panel P is fixed relative to the bracket 14. This is just one example of many possible fasteners that allow for vertical adjustment of the panel during installation and subsequently locking the ball assembly into place vertically such that the bracket can take loads once the correct position has been established.

The second leg 17 of the bracket 14 is fixed to a slot 25 in the support structure S via a bolt 26 in conjunction with an isolation washer 27 and locking nut 28. This allows for horizontal adjustment of the bracket 14 and hence the panel relative to the support structure. This is also just one example of many possible fasteners that allow for panel movement horizontally and subsequently fixing the bracket into position.

Another embodiment of the invention is a method of mounting a non-planar, architectural panel to a support structure. An embodiment of the method comprises: forming the panel from composite materials; partially embedding a plate assembly within the non-planar panel as it is formed so that a flat, circular plate of the plate assembly is embedded entirely within the panel and a socket of the plate assembly extends orthogonally out from one side of the panel, the socket having a semi-spherical interior surface and a cylindrical, externally threaded outer surface; inserting a spherical ball of a ball assembly in the semi-spherical interior surface of the socket; threading a locking collar over the externally threaded outer surface of the socket to trap the spherical ball in the socket but to allow the spherical ball to rotate relative to the socket; and attaching the ball assembly to the support structure so the panel may rotate relative to the support structure in any direction but cannot translate relative to the support structure.

Although the invention has been described with reference to the particular embodiments, it is noted that equivalents may be employed and substitutions made herein without departing from the scope of the invention.

What is claimed:

1. A mounting system for connecting a panel to a support structure, the mounting system comprising:

a plate assembly including:

a plate configured to be embedded within the panel and including a plurality of holes extending through the plate and radially spaced from a center of the plate; and a socket extending orthogonally from the plate and configured to extend from one side of the panel, the socket having a semi-spherical interior surface;

a ball assembly including a spherical ball nested in the semi-spherical interior surface of the socket and a shaft extending from the spherical ball, wherein the spherical ball is encapsulated by at least one of a resilient plastic sleeve and a coating thereby self-lubricating the socket; and an attachment structure for fixedly attaching the shaft of the ball assembly to the support structure so the panel may rotate relative to the support structure in any direction but cannot translate relative to the support structure.

2. The mounting system of claim 1, wherein the plate has a uniform thickness in a region extending radially from the socket and surrounding the holes.

3. The mounting system of claim 1, wherein the plate is between approximately one eighth to approximately one half of an inch thick and between approximately three inches to approximately eight inches in diameter.

4. The mounting system of claim 1, wherein the plurality of holes are radially elongated slots.

5. The mounting system of claim 1, the plate assembly further comprising a shock absorber configured to mitigate dynamic loading between the spherical ball and the socket.

6. The mounting system of claim 5, wherein the shock absorber is a rubber component positioned in the socket.

7. A mounting system for connecting a non-planar architectural panel to a support structure, the mounting system comprising:

a plate assembly including:

a flat, circular plate configured to be embedded within the panel and including a plurality of holes extending through the plate and radially spaced from a center of the plate; and a socket extending orthogonally from the plate and configured to extend from one side of the panel, the socket having a semi-spherical interior surface and a cylindrical, externally threaded outer surface;

a ball assembly including a spherical ball nested in the socket of the plate assembly and a threaded bolt extending from the spherical ball, wherein the spherical ball is encapsulated by at least one of a resilient plastic sleeve or a coating thereby self-lubricating the socket;

a locking collar having an internally threaded inner surface configured to engage the externally threaded outer surface of the socket to trap the spherical ball against the socket; and an attachment structure for fixedly attaching the threaded bolt of the ball assembly to the support structure so the panel may rotate relative to the support structure in any direction but is fixed in translation relative to the support structure, the attachment structure including:

an L-shaped bracket having a first leg with a first slot and a second leg with a second slot, the first and second legs extending orthogonally relative to one another, fasteners for fixing the threaded bolt of the ball assembly in the first slot of the first leg of the bracket, and fasteners for attaching the second leg of the bracket to the support structure.

8. A mounting system for connecting a panel to a support structure, the mounting system comprising:

a plate assembly including:

a plate configured to be embedded within the panel; and a socket extending orthogonally from the plate and configured to extend from one side of the panel, the socket having a semi-spherical interior surface;

a ball assembly including a spherical ball nested in the semi-spherical interior surface of the socket and a shaft extending from the spherical ball, wherein the spherical ball is encapsulated by at least one of a resilient plastic sleeve and a coating thereby self-lubricating the socket;

a locking collar having a semi-spherical interior surface, the locking collar being configured to engage the socket so that the semi-spherical interior surface of the socket and the semi-spherical interior surface of the locking collar opposingly cradle the spherical ball to trap the spherical ball against the socket; and an attachment structure for fixedly attaching the shaft of the ball assembly to the support structure so the panel may rotate relative to the support structure in any direction but cannot translate relative to the support structure.

9. The mounting system of claim 8, wherein the plate has a uniform thickness in a region extending radially from the socket and surrounding the holes.

10. The mounting system of claim 8, wherein the plate is between approximately one eighth to approximately one half of an inch thick and between approximately three inches to approximately eight inches in diameter.

11. The mounting system of claim 8, wherein the plurality of holes are radially elongated slots.

12. The mounting system of claim 8, the plate assembly further comprising a shock absorber configured to mitigate dynamic loading between the spherical ball and the socket.

13. The mounting system of claim 12, wherein the shock absorber is a rubber component positioned in the socket.

14. A mounting system for connecting a panel to a support structure, the mounting system comprising:

a plate assembly including:

a plate configured to be embedded within the panel and including a plurality of holes extending through the plate, having an annular width and radially spaced from a center of the plate; and a socket extending orthogonally from the plate and configured to extend from one side of the panel, the socket having a semi-spherical interior surface;

a ball assembly including a spherical ball nested in the semi-spherical interior surface of the socket and a shaft extending from the spherical ball;

an attachment structure for fixedly attaching the shaft of the ball assembly to the support structure so the panel may rotate relative to the support structure in any direction but cannot translate relative to the support structure; and a rubber shock absorber positioned in the socket and configured to mitigate dynamic loading between the spherical ball and the socket.

* * * * *